US008235228B2

(12) United States Patent
Vasstrand

(10) Patent No.: US 8,235,228 B2
(45) Date of Patent: Aug. 7, 2012

(54) METHOD AND APPARATUS FOR DEEP WATER DEPLOYMENT OPERATIONS

(75) Inventor: Knut Vasstrand, Blommenholm (NO)

(73) Assignee: Aker Marine Contractors AS, Oslo (NO)

( * ) Notice: Subject to any disclaimer, the term of this patent is extended or adjusted under 35 U.S.C. 154(b) by 564 days.

(21) Appl. No.: 12/428,175

(22) Filed: Apr. 22, 2009

(65) Prior Publication Data

US 2009/0261052 A1 Oct. 22, 2009

(30) Foreign Application Priority Data

Apr. 22, 2008 (NO) ..... 20081906

(51) Int. Cl.
*B66C 23/10* (2006.01)

(52) U.S. Cl. ..... 212/256; 212/259; 212/309; 254/277

(58) Field of Classification Search ..... 212/309, 212/310, 256, 259; 254/277
See application file for complete search history.

(56) References Cited

U.S. PATENT DOCUMENTS

| | | | | |
|---|---|---|---|---|
| 3,785,511 | A * | 1/1974 | Bonnamy et al. | 414/139.7 |
| 4,552,339 | A * | 11/1985 | Werners et al. | 254/277 |
| 7,543,799 | B2 * | 6/2009 | Willis et al. | 254/336 |
| 2003/0107029 | A1 * | 6/2003 | Hanson et al. | 254/362 |
| 2005/0191165 | A1 * | 9/2005 | Willis et al. | 414/803 |

* cited by examiner

*Primary Examiner* — Emmanuel M Marcelo
(74) *Attorney, Agent, or Firm* — Myers Bigel Sibley & Sajovec

(57) ABSTRACT

A method of deploying an object (14) onto the seabed in very deep water from a vessel having a heave compensated deck crane (12), comprises lowering the object a distance into the sea while being suspended in the crane wire (16).

In an initial step, a first fibre rope section (4*a*) of a first length is connected to the object (14) via a first connector (3*a*) on the object before the lowering is started and is freely run out supporting from a storage reel (13) during the descent. Subsequently, the first rope section is the object via a second connector (3*b*) located at the upper end of the first rope section (4*a*), the second connector being supported by a support mechanism (1) on the vessel deck (8), followed by off-loading the crane wire (16) and disconnecting it from the object and heaving it up said first length for connection to the second connector (3*b*) at the vessel deck and taking over the load of the object. Next, the object (14) is lowered a second length into the water by the crane while a second rope section (4*b*) connected to the second connector is freely run out from a storage reel (13) until a third connector (3*c*) located at the upper end of the second rope supports the load of the object in the support mechanism (1), whereupon the crane hook can be released and be brought up for re-connection to the third connector (3*c*) for the subsequent deployment, and any further deployment by addition to the string of ropes, thereby allowing the object (14) to reach a depth of up to 3000 meter, or even more.

14 Claims, 8 Drawing Sheets

METHOD AND APPARATUS FOR DEEP WATER DEPLOYMENT OPERATIONS

RELATED APPLICATION

This application claims the benefit of Norwegian Patent Application No. 20081906, filed on Apr. 22, 2008, in the Norwegian Patent Office, the disclosure of which is incorporated herein in its entirety by reference.

FIELD OF THE INVENTION

The present invention relates to equipment and a method of deploying an object on the seabed that is part of the infrastructure in oil and gas field located in very deep water, i.e. more than 1000 meter.

BACKGROUND

Conventional offshore installation methods are normally based on lifting the object onto the seabed with a crane construction. Such operations set high demands to crane capacity and can be very weather sensitive operations. For very deep water installation, i.e. more than 1000 meter of water depth, the weight of the crane wire starts affecting and reducing and/or minimizing the pay-load of the crane.

SUMMARY

The present invention is presenting a method on how this reduction of payload can be avoided. The invention also comprises an apparatus.

Also, when a passive heave compensating is applied in certain areas with extreme sea-swell conditions, the support mechanism may be simplified as the roundel may be connected directly between the line from heave compensator and the rope-section carrying the object when the crane hook is disconnected for preparation of the next lowering-step making the cradle obsolete in these instances.

The passive heave compensating system when introduced also lends itself to connect a winch to this system allowing the object to be lowered onto seabed by the winch via the passive heave compensator as an alternative to lowering on the crane for the last lowering step.

In order to avoid the crane wire affecting the payload at deep water, the usage of the crane wire is proposed limited to typically 1000 meter water depth, and fibre rope is instead introduced for further depths to be reached. Fibre rope can have a specific weight of 0.97-1.4, depending of type of rope, and is as such close to neutral in water, with no or a reduced and/or minimum effect on crane load. The fibre ropes have generally a strength superior of steel and stiffness close to steel for the preferred ropes for this service, thus having behaviour under load not deviating much from that of a steel wire.

The present invention is presenting a method on how this reduction of payload can be avoided. The invention also comprises an apparatus.

In this method, when deploying the object by the crane from the deck of a vessel, the crane wire is proposed used for the first 1000 meter of deployment. However, a first fibre rope section is also connected to the object via a roundel on the lifting slings and is freely unreeled from a storage reel until the object is reaching 1000 meter of water depth.

At 1000 meter of water depth, the first fibre rope section takes over the load of the object and supports it from a support mechanism located on the edge of the vessel deck. The support mechanism consists of a support-cradle supporting a roundel connected to the end of the fibre rope. The crane wire hook is disconnected from the object by a ROV and heaved up to above the deck level.

The crane wire hook is then once again connected onto the object via connection to a roundel at top end of the first suspended fibre rope, followed by a descent of the object suspended on the crane wire and rope another 1000 meter down to 2000 meter of water depth. A second fibre rope section on the storage reel is connected to the object via the roundel on top of the first rope section and freely unreeled until the object is reaching this water depth.

At 2000 meter of water depth, the fibre ropes takes over the load and supports the object from the support mechanism located on the edge of the vessel deck. The crane wire hook is disconnected from the object by a ROV and heaved up to above the deck level.

The crane wire hook is then once again connected onto the object via connection to a roundel at the top end of the second fibre rope section, followed by a descent of the object suspended on the crane wire and ropes another 1000 meter down to 3000 meter of water depth.

For landing the object onto the seabed, the active heave compensating system on the crane will be activated for the last 100 meter. This may reduce and/or minimize the impact onto the object during the actual landing.

For installation in certain areas of the world, typically West Africa, sea swell might be present. For these areas, a passive heave compensating system is introduced into the support mechanism on the edge of the vessel deck for a short period of intermediate support of the object when it is suspended by fibre ropes while the crane hook is disconnected.

BRIEF DESCRIPTION OF THE DRAWINGS

The present invention shall be described in the following with a reference to the is attached drawings which illustrate a preferred embodiment, wherein.

DETAILED DESCRIPTION OF THE PREFERRED EMBODIMENT

Figure 1:
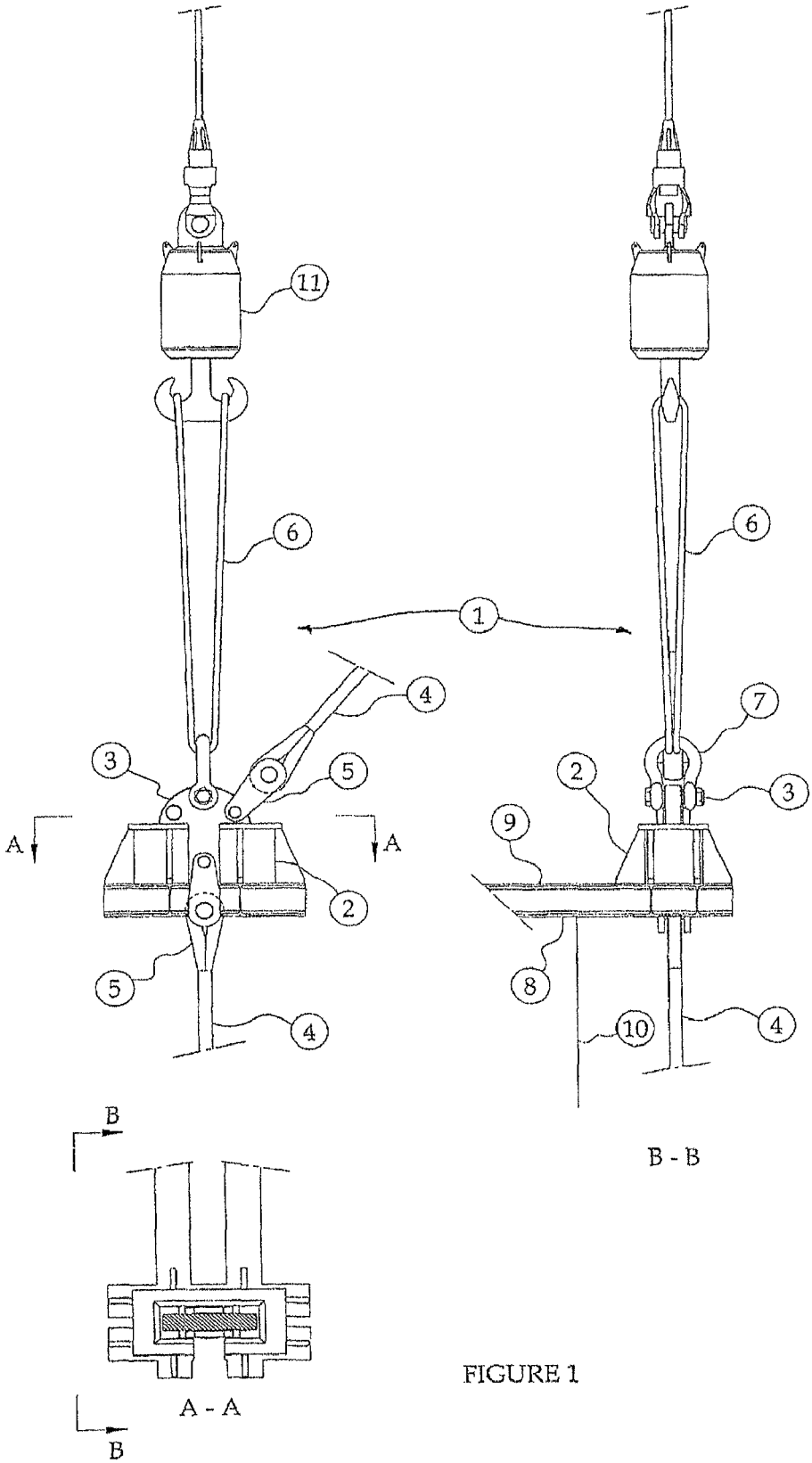
FIG. 1 is showing front and side elevations and a section through the support mechanism comprising a hang-off cradle capable to support roundel plates that are connecting 1000 meter rope section. The support mechanism is located on a structural grillage on the edge of the vessel deck underneath the deck crane.

FIG. 1 is showing the support mechanism 1 made up by a hang-off cradle 2 supporting the roundel plate 3 that is connecting the 1000 meter rope sections 4. The roundel 3 has a number of holes in the circumference for rope and crane hook connections via rope thimbles 5 and shackles 7.

The hang-off cradle has a vertical cut in the side plate, allowing the rope 4 to enter sideways into the hang-off cradle 2 and the roundel 3 to be lowered into the cradle for support.

The fibre ropes 4 are connected to the roundel 3 by a thimble 5, and the crane hook 11 is connected to the same by a grommet 6 and shackle 7.

The hang-off cradle 2 is supported on the edge of the vessel deck 8 by a structural grillage 9 cantilevered on the vessel side 10.

Figure 2:
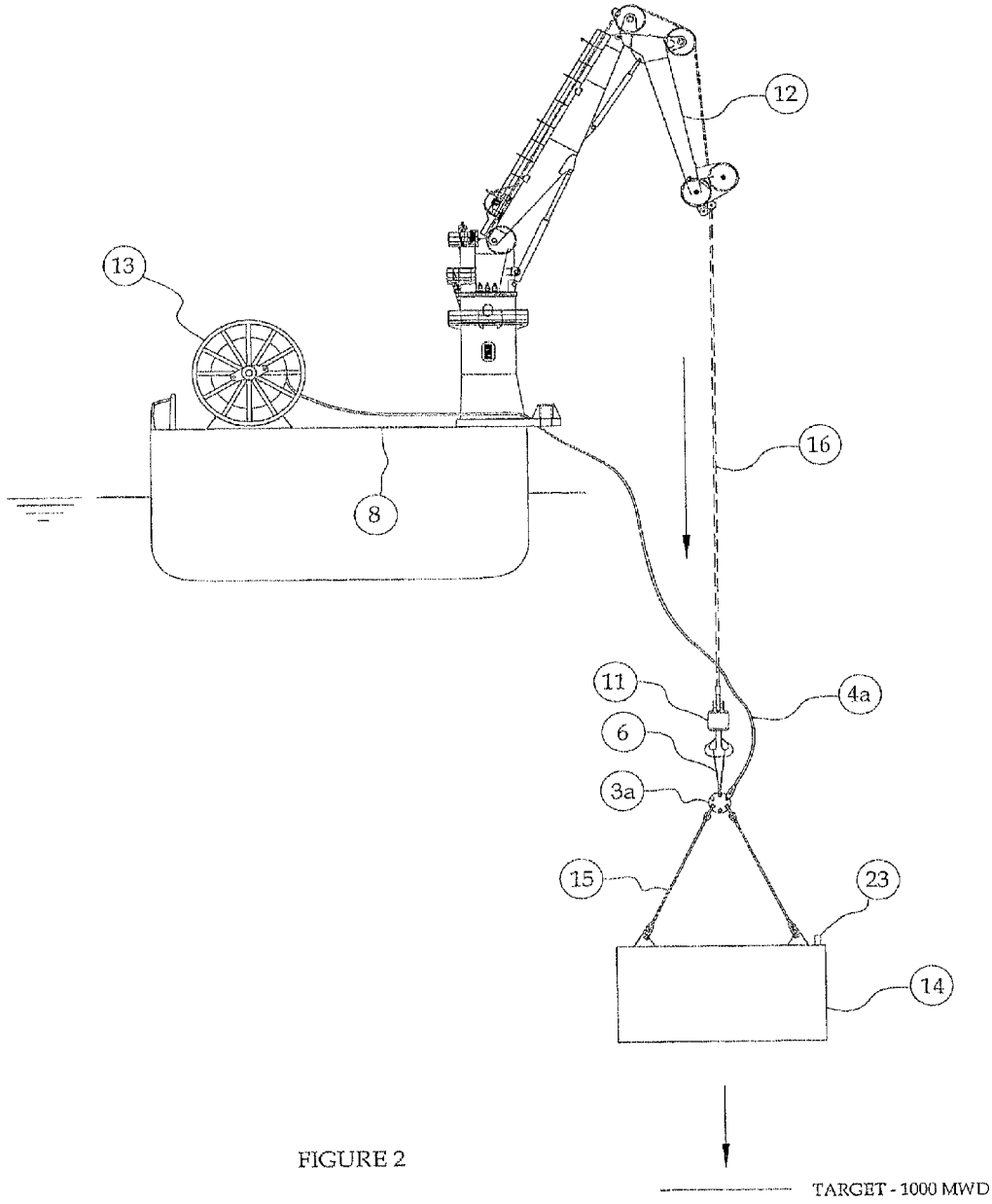
FIG. 2 is a transverse section of the vessel, showing the start of the first sequence of the deployment operation, with the crane launching the object from deck of the vessel onto the first 1000 meter of deployment with the rope connected to the roundel at the object slings, the rope being freely unreeled from a deck storage reel capable of storing two separate rope sections, each 1000 meter of length. The support mechanism is indicated on the edge of the vessel deck.

FIG. 2 is showing the execution of the first sequence of deployment operation, with the object 14 with slings 15 and associated first roundel 3*a* being lowered down the first 1000 meter of the water depth on the crane wire 16 with the crane hook 11 and the crane boom 12, while the first 1000 meter of fibre rope section 4*a* connected to the first roundel 3*a* is freely run out from the storage reel 13 located on the vessel deck 8.

The object 14, being a structure or process unit, is suspended from the roundel 3*a* by slings with shackles 15.

The rope storage reel 13 is capable of storing typically two 1000 meter rope sections.

Figure 3:
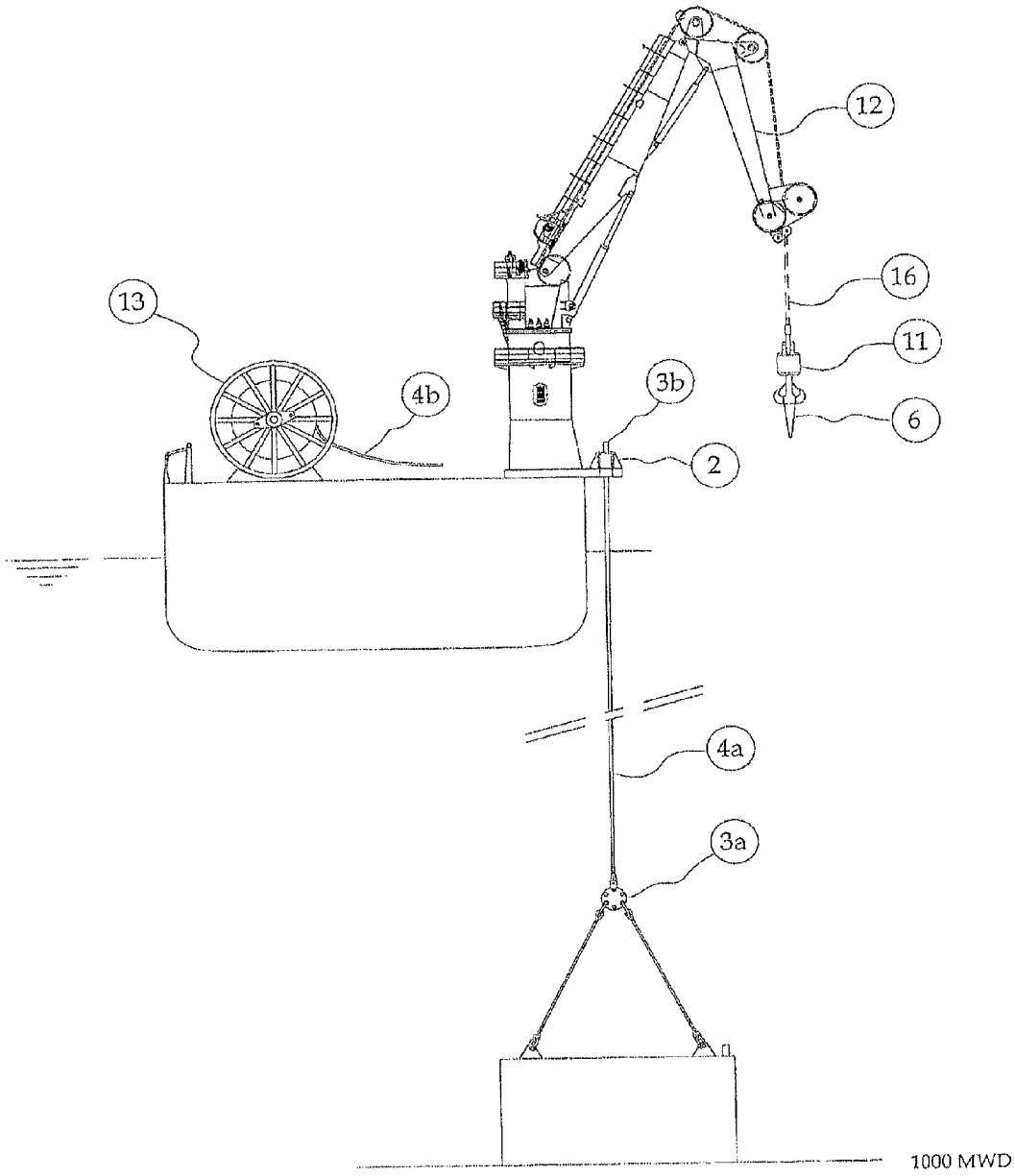
FIG. 3 is a transverse section of the vessel, showing the first sequence completed, with the object suspended in the first 1000 meter of rope section from the support mechanism on the edge of the vessel deck, and crane hook disconnected from the object and heaved up. The second 1000 meter rope section rests on the storage reel ready to be pulled out for connection to the first rope section.

The execution of the first sequence of the deployment operation is shown completed in FIG. 3, where lowering of the first 1000 meter of fibre rope section 4*a* has ended and been supported in the cradle 2 by landing the second roundel 3*b*, which has been connected to the first rope section, into it. The crane hook 11 and grommet 6 are disconnected from the first roundel 3*a* and heaved up and located beneath the crane boom 12. The second fibre rope section 4*b* remains on the storage reel 13, ready to be pulled out and connected via the second roundel 3*b* to the first rope section 4*a*.

Figure 4:
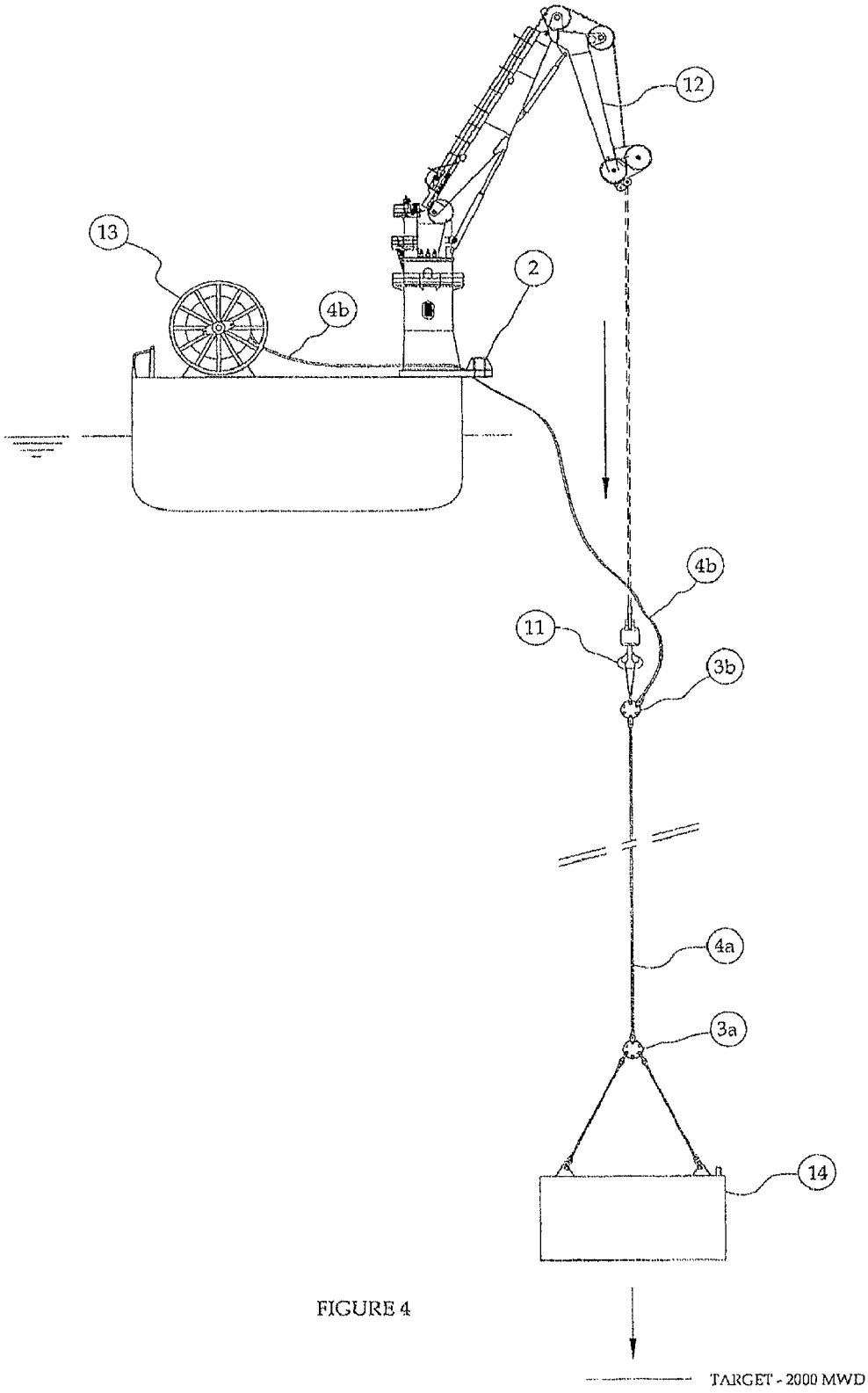
FIG. 4 is a transverse section of the vessel, showing the second sequence of the deployment operation, with crane hook connected to the roundel at top of the first rope section and the object being lowered the next 1000 meter, while the second rope section has been connected to the same top of first rope section and being freely unreeled from the deck storage reel.

FIG. 4 is showing the execution of the second sequence of the deployment operation, with the crane hook 11 connected to the second roundel 3*b* on top of the first rope section 4*a*, by lowering the object 14 the next 1000 meter while the second rope section 4*b* is connected to the same roundel 3*b* and is freely unreeled from the deck storage reel 13. The object 14 will then reach a depth of 2000 meter.

Figure 5:
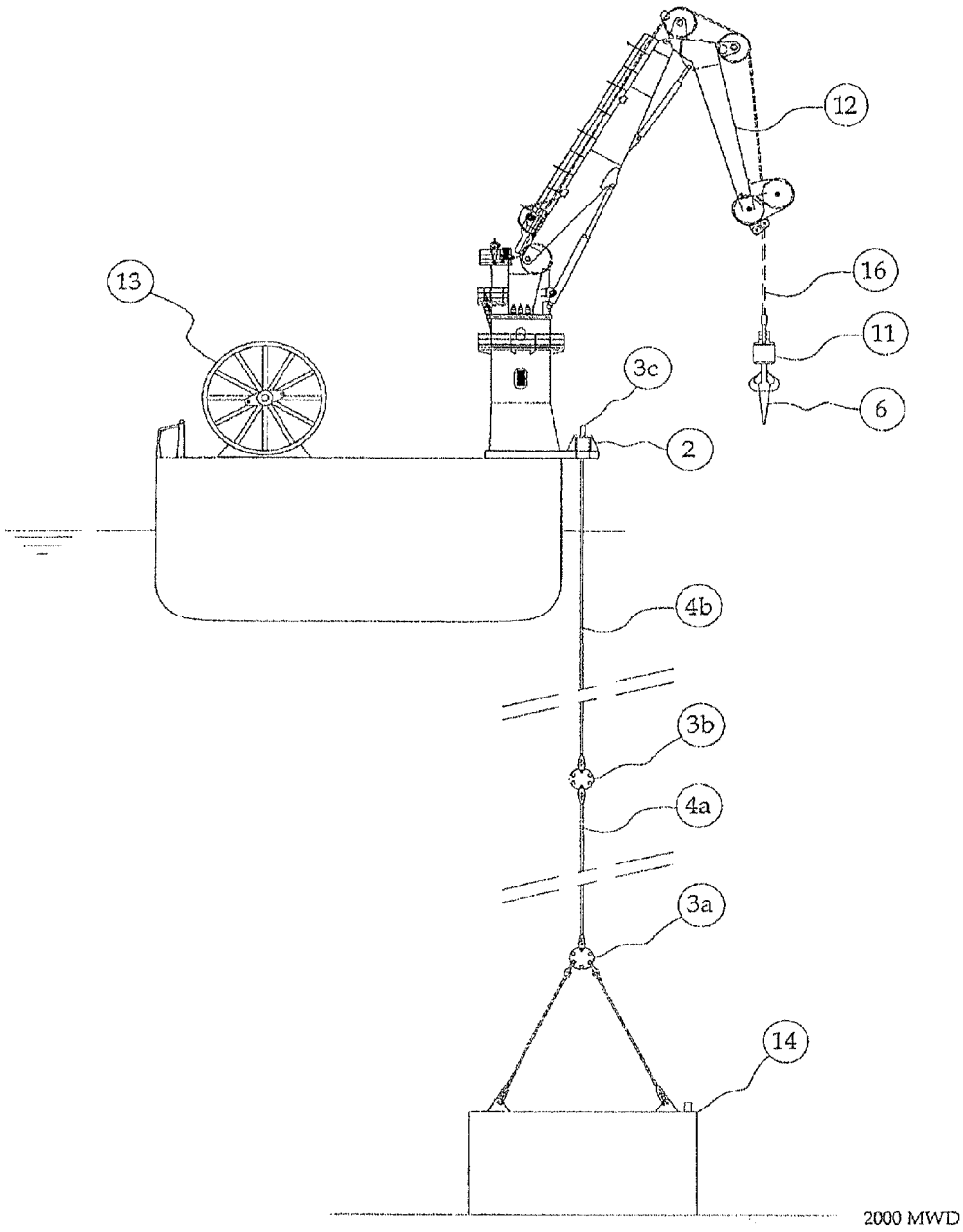
FIG. 5 is a transverse section of the vessel, showing the second sequence completed with the object suspended in the two first 1000 meter rope sections from the support mechanism on the edge of the vessel deck, and the crane hook having been disconnected from the object and heaved up. The deck storage reel is now empty.

FIG. 5 is showing the second sequence of the deployment when completed, with the object 14 suspended in the two first 1000 meter rope sections 4*a* and 4*b* from the support mechanism on the edge of the vessel deck 8, and with the crane hook 11 disconnected from the object 14 and heaved up. Deck storage reel 13 is now empty.

Figure 6:
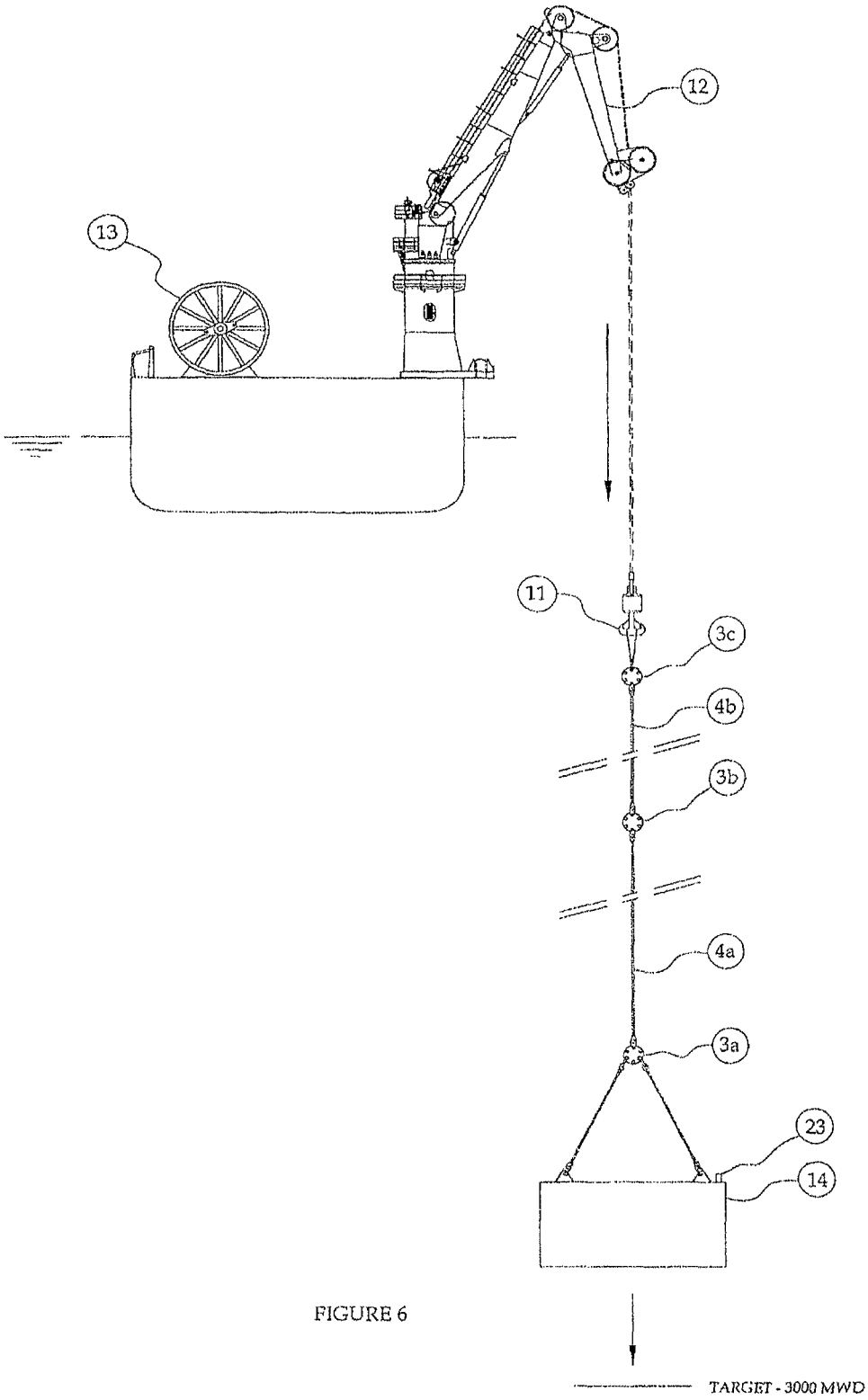
FIG. 6 is a transverse section of the vessel, showing the third sequence of the deployment operation, with the crane hook connected to the top of the second rope section and the object being lowered the last 1000 meter to the seabed.

FIG. 6 is showing the execution of the third sequence of the deployment operation, with the crane hook 11 connected to the third roundel 3*c* on top of the second rope section 4*b*, by lowering the object 14 the last 1000 meter to the seabed. The object 14 will then reach a depth of 3000 meter.

Figure 7:
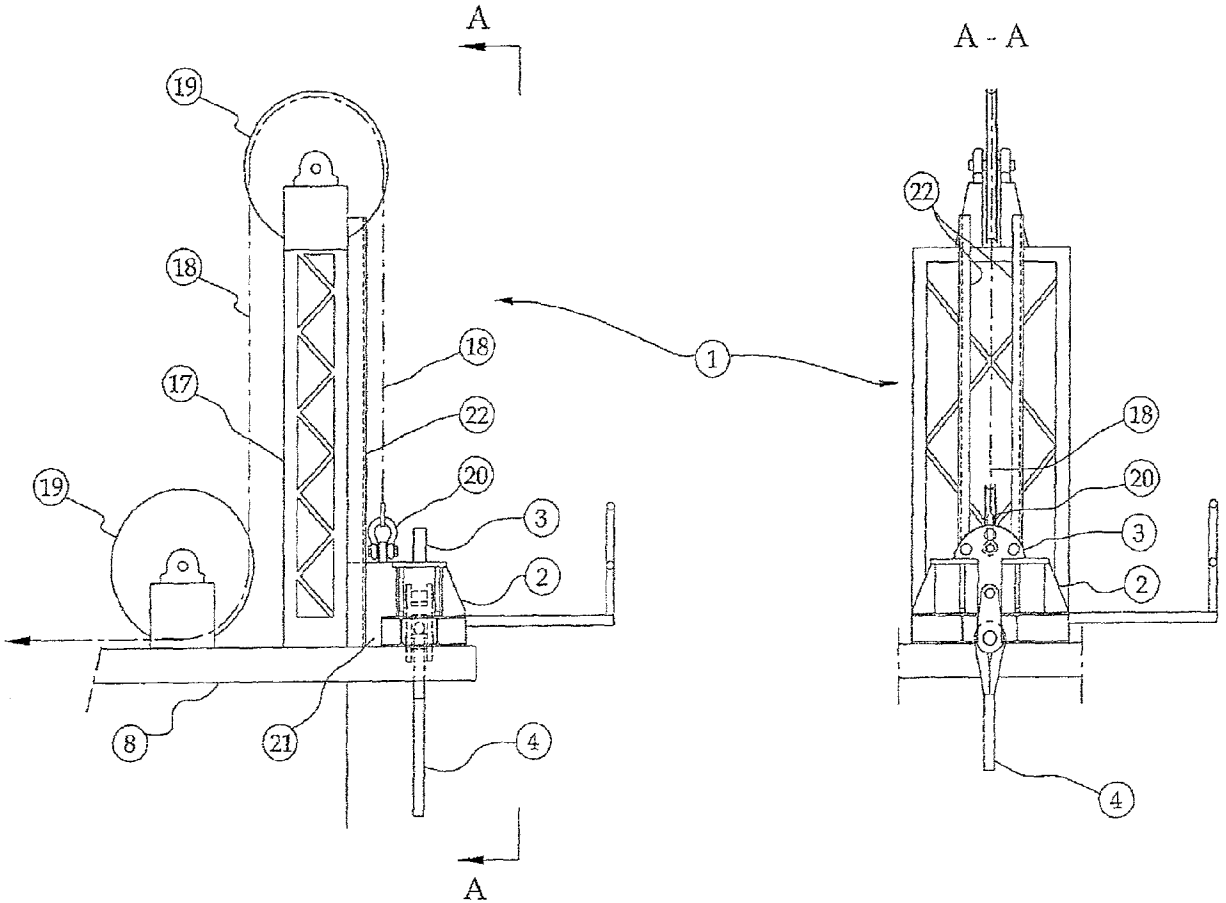
FIG. 7 is a side and a front elevation drawing of the support mechanism, showing an elevator tower introduced when needed under special sea swell conditions, allowing a passive heave compensator to be connected to the hang-off cradle whenever the roundel with the object load is supported in the cradle.

FIG. 7 is side and front elevation drawings of the support mechanism 1, showing an elevator tower 17 introduced whenever needed under special sea swell condition, allowing a passive heave compensator (not shown) to be connected to the hang-off cradle 2 whenever the roundel 3 with the object load is supported in the cradle. The passive heave compensator is connected to the cradle via a shackle 20 and a wire line 18 running on sheaves 19. The cradle is fitted with a guide shoe 21, allowing the assembly to run vertically along the elevator-guide 22 with a typical stroke of 2-3 meter.

Figure 8:
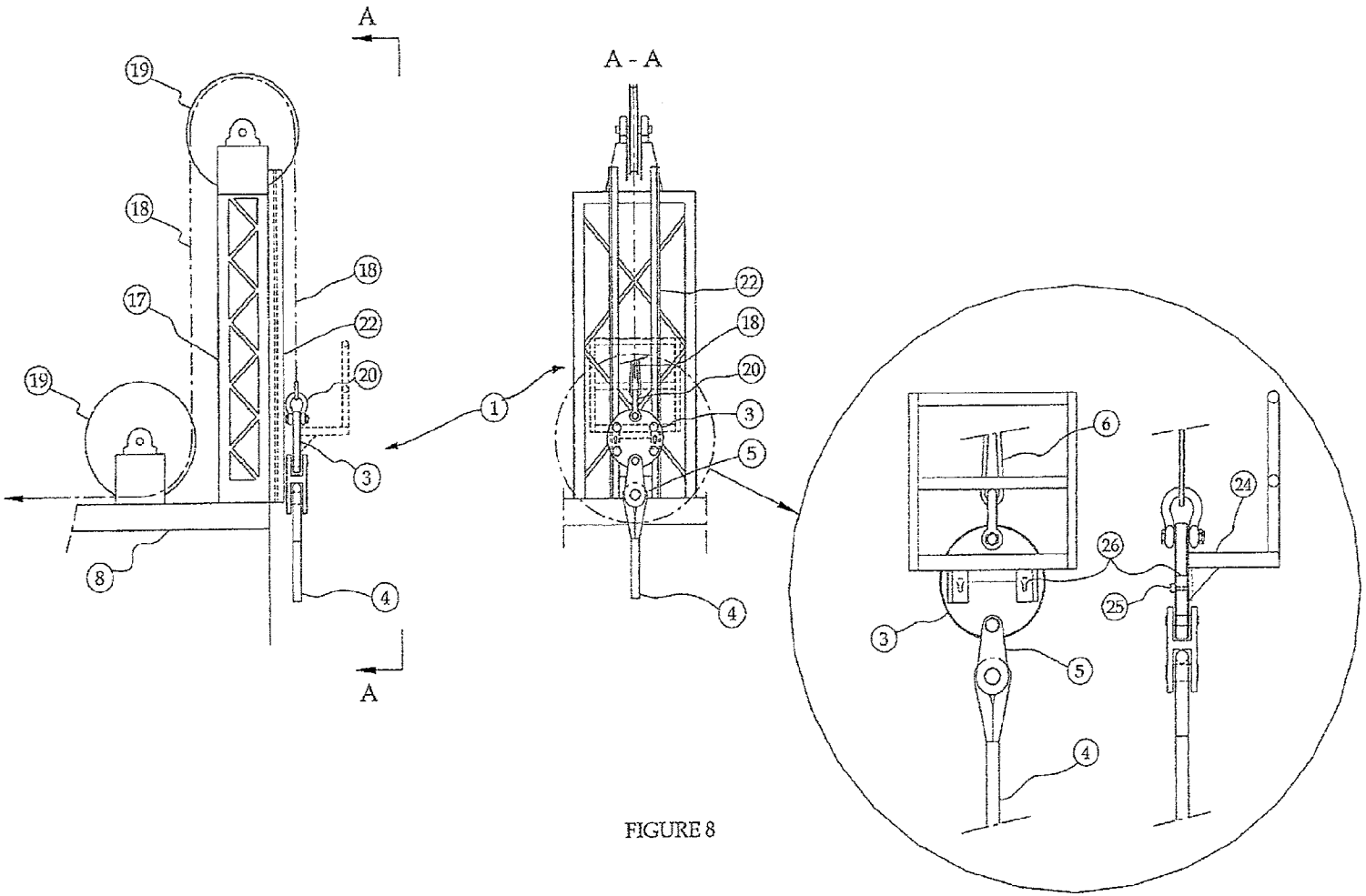
FIG. 8 is side and front elevation drawings and an enlarged detail of the support mechanism with the main item now being the elevator tower shown in FIG. 7 but without the cradle. This arrangement is introduced when needed under special sea swell condition and is allowing the roundel to be connected directly between the heave compensator and the rope section carrying the object. A detachable access platform on the roundel is arranged for ease of the rigging work on the roundel.

FIG. 8 is side and front elevation drawings and an enlarged detail of the support mechanism 1 with the main item now being an elevator tower 17 but without the cradle. Whenever special sea swell condition requires passive heave compensating, this arrangement allows a roundel 3 to be connected directly between a passive heave compensator (not shown) and a rope section 4, without the support of any cradle 2. The passive heave compensator is connected to the roundel via a shackle 20 and a wire line 18 running on sheaves 19 onto the passive heave compensator and possibly also a winch, if required. The roundel will run vertically along the elevator-guide 22, allowing a stroke of typical 2-3 meter. An access platform 24 shown stippled is connected to the roundel 3 to ease the access for rigging work on the roundel. The platform is made detachable by a double key 25 and key-hole 26 locking mechanism, as indicated on the roundel 3. A small auxiliary crane will probably be adequate to assist rigging personnel in the re-rigging of the roundel for each new lowering step.

The invention claimed is:

1. A method of deploying an object having a load onto a seabed in very deep water of a sea from a vessel having a heave compensated crane, comprising:

lowering the object a distance into the sea while being suspended by a crane wire, wherein a first fibre rope section of a first length is connected to the object via a first connector on the object before the lowering is started and is freely run out from a storage reel during the lowering and subsequently supports the object via a second connector located at an upper end of the first rope section, the second connector being supported by a support mechanism on the vessel, off-loading the crane wire and disconnecting it from the object and heaving it up said first length for connection to the second connector at the vessel and taking over the load of the object, lowering the object a second length into the water by the crane while a second rope section connected to the second connector is freely run out from the storage reel until a third connector located at an upper end of the second rope supports the load of the object in the support mechanism, whereupon the crane wire is released and brought up for re-connection to the third connector for subsequent deployment, and any further deployment in addition to the first and second ropes, thereby allowing the object to reach a depth of up to 3000 meters or more.

2. A method according to claim 1, wherein the object located on the seabed in very deep water is retrieved onto the vessel by lifting the object by the crane from the seabed onto the vessel by reversing the sequence of operations defined therein.

3. A method according to claim 2, wherein an accelerometer located on the object and connected to the heave compensated crane acoustically or via a cable to an ROV or vessel, is monitoring any resonance behaviour of the rope sections and object prior to landing the object onto a deep water seabed location, in order to reduce and/or minimise the impact onto the object during the actual landing on the seabed.

4. A method according to claim 1, wherein an accelerometer located on the object and connected to the heave compensated crane acoustically or via a cable to an ROV or vessel, is monitoring any resonance behaviour of the rope sections and object prior to landing the object onto a deep water seabed location, in order to reduce and/or minimise the impact onto the object during the actual landing on the seabed.

5. An apparatus for supporting a load of a submerged object suspended from a vessel, wherein said apparatus comprises a suspension device which is arranged at or near one side of the vessel and is provided with a hang-off cradle capable of supporting a connector connected to at least one fibre rope section for carrying the load of the object, the suspension device comprising a heave compensated crane having a wire for releasable attachment to said connector and lowering of the connector with said at least one fibre rope section and object towards a seabed.

6. An apparatus according to claim 5, wherein the cradle has a vertical cut facing away from the side of the vessel to allow the rope to enter sideways into the cradle for subsequent lowering of the connector into the cradle for supporting the load of the object.

7. An apparatus according to claim 6, wherein the connector is a roundel which has a number of holes along the circumference enabling rope sections to be connected via thimbles and a crane hook to be connected via a shackle and a grommet.

8. An apparatus according to claim 6, wherein the cradle has a vertical motion compensation system.

9. An apparatus according to claim 6, wherein the connector is a roundel made from plate material.

10. An apparatus according to claim 5, further comprising an elevator tower with two sheaves which allows a wire line from a passive heave compensator on a deck of the vessel to be connected to, suspend and guide the cradle, which is fitted with guide-shoes, along elevator guides on one side of the tower with a vertical stroke of 2-3 meters when the connector with the load of the object is being supported by the cradle, thereby allowing the connector to move vertically and mitigate the heave of the vessel and avoid slack in the ropes and avoid any snap loads while the connector is supported by the cradle.

11. An apparatus according to claim 5, wherein the suspension device has a vertical motion compensation system comprising an elevator tower with two sheaves which allows a wire line from a passive heave compensator on the vessel to be connected to said connector, the connector being guided on one side of the tower with a vertical stroke of 2-3 meters when the connector is supporting the object, thereby allowing the connector to move vertically and mitigate the heave of the vessel and avoid slack in the ropes and any snap loads.

12. An apparatus according to claim 5, wherein the connector is a roundel which has a number of holes along a circumference of the roundel enabling rope sections to be connected via thimbles and a crane hook to be connected via a shackle and a grommet.

13. An apparatus according to claim 5, wherein the cradle has a vertical motion compensation system.

14. An apparatus according to claim 5, wherein the connector is a roundel made from plate material.

* * * * *